US005950251A

United States Patent [19]

Cost et al.

[11] Patent Number: 5,950,251

[45] Date of Patent: Sep. 14, 1999

[54] PORTABLE TOILET AND WASTE RECEPTACLE SYSTEM

[76] Inventors: Timothy L. Cost, 2745 N.E. 27th St. No. 2; Michele M. Greene, 3170 N. Federal Highway, Apt. 105, both of Lighthouse Point, Fla. 33064

[21] Appl. No.: 09/094,028

[22] Filed: Jun. 9, 1998

Related U.S. Application Data

[63] Continuation-in-part of application No. 08/214,013, Mar. 16, 1994, which is a continuation of application No. 07/916, 957, Jul. 20, 1992, abandoned.

[51] Int. Cl.[6] ..... A47K 11/04

[52] U.S. Cl. ..... 4/483; 4/234; 4/242.1; 4/484; 220/495.11; 141/314; 141/316; 248/101

[58] Field of Search ..... 4/242.1, 234, 235, 4/483, 484, 458, 479; 141/10, 313, 314, 316, 390, 391; 248/95, 97, 99, 101; 220/495.01, 495.06, 495.08, 495.1, 495.11, 908.1, 908.3

[56] References Cited

U.S. PATENT DOCUMENTS

| | | | |
|---|---|---|---|
| 654,301 | 7/1900 | Barnes . | |
| 2,493,362 | 1/1950 | Rocker . | |
| 2,940,482 | 6/1960 | Peterson | 141/314 |
| 3,343,179 | 9/1967 | Sellars et al. . | |
| 3,422,985 | 1/1969 | Rinehart . | |
| 3,428,967 | 2/1969 | Hughes . | |
| 3,484,875 | 12/1969 | Eisenberg . | |
| 3,671,981 | 6/1972 | Smith . | |
| 3,811,462 | 5/1974 | Feliz . | |
| 4,807,308 | 2/1989 | Person et al. . | |
| 4,962,551 | 10/1990 | Bly . | |
| 5,170,516 | 12/1992 | Davison . | |

FOREIGN PATENT DOCUMENTS

| | | |
|---|---|---|
| 628635 | 10/1927 | France . |
| 5838 | of 1909 | United Kingdom . |
| 18714 | of 1914 | United Kingdom . |
| 238705 | 8/1925 | United Kingdom . |

*Primary Examiner*—Henry J. Recla
*Assistant Examiner*—Peter T deVore
*Attorney, Agent, or Firm*—Malin, Haley, DiMaggio & Crosby, PA

[57] ABSTRACT

A portable toilet and waste receptacle system is provided including a toilet seat and a conventional bucket for performing toilet functions, said seat being attachable to the upper rim of a bucket for use in locations not having conventional toilet facilities. In one embodiment, a flexible waste container can be placed within the bucket to receive human waste. The flexible waste container can be sealed, stored in the bucket, and a separate sealable lid can be placed onto the bucket to seal-in the waste contained therein.

6 Claims, 3 Drawing Sheets

PORTABLE TOILET AND WASTE RECEPTACLE SYSTEM

CROSS-REFERENCE TO RELATED APPLICATIONS

This is a continuation-in-part of application Ser. No. 08/214,013, filed Mar. 16, 1994, which is a continuation of application No. 07/916,957, filed Jul. 20, 1992, now abandoned.

STATEMENT REGARDING FEDERALLY SPONSORED RESEARCH OR DEVELOPMENT

Not applicable.

BACKGROUND OF THE INVENTION

1. Field of the Invention

This invention relates to a specially designed toilet seat that includes a lower base groove that fits snugly on a rigid container, such as a five gallon bucket, and including a flexible waste receiving and storage container and separate sealable lid. With the use of the toilet seat, flexible waste container, and sealable lid, a five gallon bucket can serve as a portable waste storage container.

2. Description of Related Art

Most small boats anywhere from 15 to 25 feet do not have a conventional "head" or toilet facility as found in much larger boats. Often, one can be in a small boat far out to sea and is forced to go to the bathroom in the water surrounding the boat. This can often be awkward for women, even if urinating, and can be embarrassing. Because of the small size of the boat, however, installing a traditional "head" is not feasible. Sometimes it is even required to come back to shore so that someone can use an available bathroom facility, interrupting the purpose of the boating outing. Most boats, however, regardless of size, include buckets that are used for various tasks of universal utility and are stored either in the boat in a front cuddy compartment or under a steering console or throttle console.

In many instances, human waste product cannot simply be dumped overboard, but must be stored and transported until such time as the waste can be properly disposed of.

In other applications, such as in natural disasters and other emergency situations, portable toilets can be in great demand. The contents of portable toilets pose serious health risks if not properly handled and disposed of.

U.S. Pat. No. 5,170,516 to Davison, discloses a utility seat that includes a plastic bag used to line a bucket to which a toilet seat is attached. The toilet seat includes a closable center plug that has an external o-ring to seal against the inner rim of the toilet seat to seal-in the contents of the bucket. However, the device of Davison must have the toilet seat and center plug attached to the bucket at all times to seal the bucket. When the bucket becomes full, the toilet seat and plug must remain in place to seal the bucket, or the contents of the bucket must be transferred to another container.

BRIEF SUMMARY OF THE INVENTION

The present invention provides a portable waste dispose system and includes a toilet seat that can be utilized in conjunction with a conventional bucket such that the seat attaches safely and conveniently to the top rim of the bucket and conveniently disconnects when required for storage. A flexible waste disposal container is placed within the bucket to receive waste products during use. The waste disposal container lines the bucket and is secured between the bucket and the toilet seat. A separate sealable lid can be utilized to secure the contents of the bucket.

The toilet seat for attachment to a conventional bucket upper rim includes a rigid, preferably hard plastic, circular or oval shaped body formed of an arcuate cross section joined as a ring, having a large substantially circular or elliptical opening passing therethrough, said oval body having a top surface that is arcuate throughout and shaped with an internal opening for a human being to sit thereupon and a bottom surface portion that includes a plurality of structural members both radially and circularly disposed increasing the structure of the unit pre-molded with the entire body, said bottom portion including a circular groove formed by two circular walls disposed around the bottom portion concentrically disposed around the central opening of the body portion and being sized in diameter to fit on a conventional container such as a bucket of predetermined size, such that the two parallel walls form a receiving groove that allows attachment of the seat onto the upper rim of the conventional container.

The upper rigid surface of the seat may be contoured much like a conventional toilet seat, having arcuate edge portions on the outer and inner edges forming the opening where a person sits and central flat portions so that the seat is basically comfortable for a human being in a seated position. It is sufficient structurally to support the weight of a human being in a seated position for going to the bathroom into a conventional container.

The lower bottom surface may be contoured to provide a uniform thickness of the body member having indentation or compartments that may include radially disposed support members uniformly molded which join the inner and outer circular flanges that form a groove circularly that receives the upper rim of She conventional container. Typically, a three or five gallon bucket is envisioned for use with the supporting groove in the bottom of the toilet seat.

Other type of connectors besides the circular supporting groove could be envisioned such as tabs at certain spaces to hold the seat in position.

In one embodiment, a flexible waste container can be inserted into the interior of a suitable bucket to provide a liner to receive the waste product. The flexible waste container is secured between the upper rim of the bucket and the receiving groove of the toilet seat. A separate sealable lid is provided that can be utilized to seal-in the contents of the bucket after use.

To use the device for a portable emergency toilet system, one would place the seat itself firmly downwardly on the top of a five gallon bucket or other conventional circular container that will support human weight so that the supporting ridge or groove meshes and receives the upper rim of the bucket. Prior to attaching the seat, a flexible waste container can be placed within the bucket to form a waste receiving container. Flexible waste containers are known in the art and are similar to conventional plastic bags, and include the type utilized in the medical field for storage of waste products. The flexible waste container is placed within the bucket, and over the top rim forming a liner. The toilet seat then firmly secures the flexible container between the bucket rim and the lower groove in the toilet seat.

The seat may be quickly removed and stored in a convenient location. A lid can then be placed over the bucket having an o-ring, or similar seal, to seal the waste material within the bucket. The flexible container within the bucket can be sealed off after each use and stored within the bucket, so that each use would require a fresh flexible container. Alternately, the flexible container could be utilized a plurality of times before sealing within the bucket.

It is an object of the present invention to provide a portable toilet and waste receptacle system including a toilet seat for use with a conventional bucket or other type cylindrical container and including a flexible waste storage receptacle.

It is another object of the present invention to provide a portable toilet and waste receptacle system including a toilet seat for use with a conventional existing bucket or other type cylindrical container for emergency use at sea to allow one to go to the bathroom in a seated position.

It is yet another object of the present invention to provide a portable toilet and waste receptacle system including a toilet seat for use at construction sites, wilderness areas, emergency situations, and in other environments where conventional toilet facilities are not available.

It is still another object of the present invention to provide a portable toilet and waste receptacle system including a toilet seat for use with a conventional bucket or other type cylindrical container, including a flexible waste storage receptacle, and a separate sealable lid.

In accordance with these and other objects which will be apparent hereinafter, the instant invention will now become described with particular reference to the accompanying drawings.

DETAILED DESCRIPTION OF THE INVENTION

Figure 1:
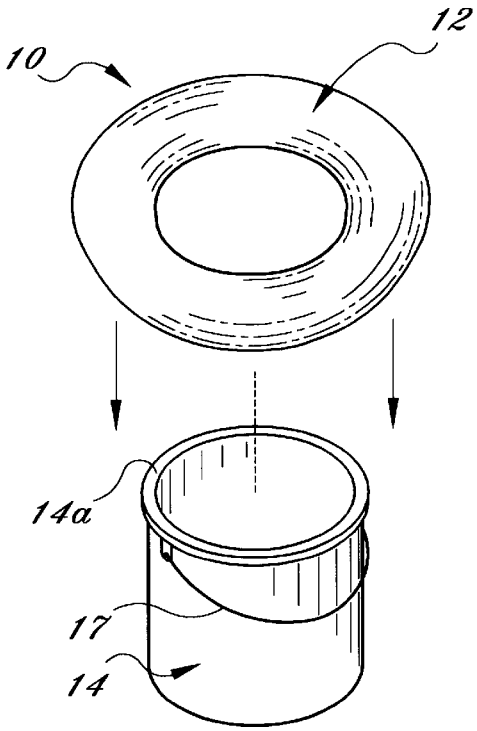
FIG. 1 shows a perspective view partially exploded of a first embodiment of the present invention toilet seat system positioned Above a conventional cylindrical bucket container.

Referring now to the drawings and in particular FIG. 1, a first embodiment of the portable toilet and waste disposal system of the present invention is shown generally at 10 suspended above a container, which can be a conventional bucket 14, the invention comprising the toilet seat 12. In operation, the toilet seat 12 is mounted on the upper rim 14*a* of bucket 14. The bucket 14 may also include a wire handle 17. The bucket and handle being conventional.

Figure 2:
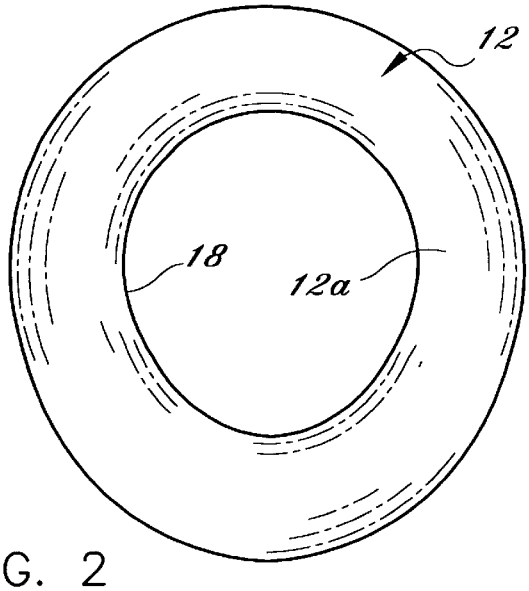
FIG. 2 shows a top plan view of the embodiment of FIG. 1.

FIG. 2 shows a top view of the first embodiment of the invention comprising a toilet seat 12 having an upper curved or partially curved surface 12*a* that has an inner opening defined by the lip 18 around the central portion of the device. Thus, when looking at FIG. 2 the device is substantially a circular or elliptical body having a circular or elliptical opening defined by the perimeter 18. The material is preferred to be a heavy duty plastic, but could be made of other materials suitable to support human weight when sitting on the seat. Also, the particular shape could include more elongated elliptical or other shapes both for the outer perimeter and the inside opening 18 as desired.

Figure 3:
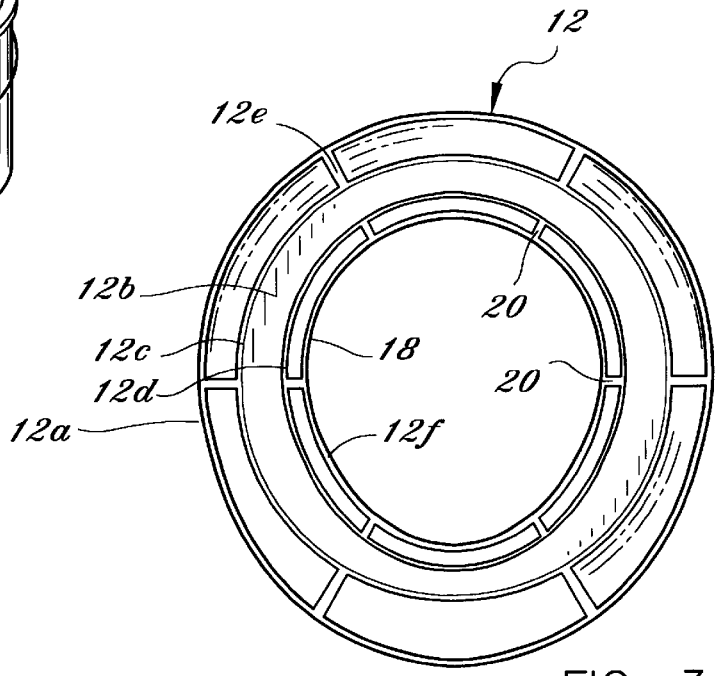
FIG. 3 shows a bottom plan view of that of FIG. 2.

Referring to FIG. 3, the bottom side of toilet seat 12 is shown. Basically, the bottom side also is a concave version of the convex side 12*a* shown in FIG. 3 with the addition of a plurality of either circumferential circular or radially disposed integrally molded support members as described further herein. The support members such as 12*e* along with the concave inner surface of the seat 12 form a plurality of compartments peripherally between the outer edge formed by 12*a* and a first inner support ring 12*c* which is substantially a circular or elliptical wall that is concentrically disposed around the opening 18 and includes a plurality of radially disposed rigid walls 12*e*.

A second compartment 12*b*, which in effect is a circular or elliptical groove, coaxially and concentrically disposed around the opening formed by lip 18, includes a second circular or elliptical raised ring wall 12*d* spaced a predetermined distance from wall 12*c* so that the groove formed therein 12*b* will receive and fit snugly around the upper rim 14*a* (FIG. 1) of a conventional bucket. Thus, the circular or elliptical walls 12*c* and 12*d*, defining the groove 12*b*, are raised enough (at least one-half inch or greater) to fully support the seat on top of a conventional bucket 14. This is a safety feature so that the toilet seat will not slip when a person's weight is supported while sitting on the toilet seat. Additional support walls radially, such as 20, may be included going all the way to the inner lip 18, which basically is a ring that is the thickness of the seat housing itself, approximately one-half inch in thickness throughout.

It is important that the support walls 12*c* and 12*d* have diameters that fit concentrically around the rim 14*a* of the bucket. Other than that fitting, the rim 18 can be of a predetermined shape, not necessarily circular but elliptical as in a conventional toilet seat, as is the outer ring or rim of the body shown as the outer edge of 12*a*.

Figure 4:
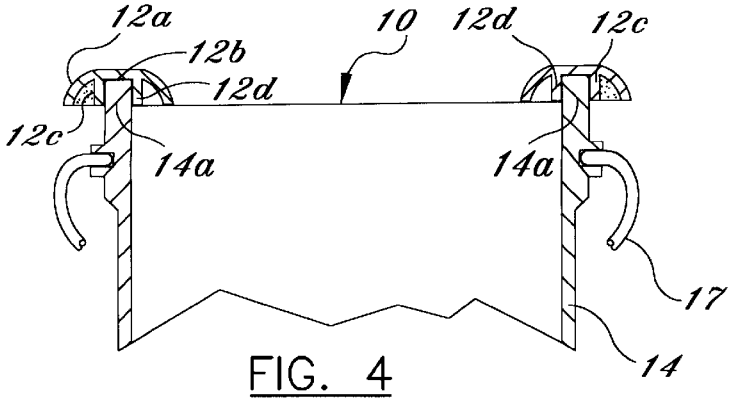
FIG. 4 shows a side elevation view in cross-section showing the embodiment of FIG. 1 mounted on a conventional bucket which is shown partially cut away and in cross-section.

FIG. 4 shows the seat 10 mounted on bucket 14 with the groove 12*b* receiving the upper rim 14*a* of the bucket all the way around for stability so that the seat cannot slide sideways, but is firmly and snugly attached to the bucket.

Although the supporting groove 12*b* formed by support walls 12*c* and 12*d*, which are raised walls from the concave inner surface of the seat are shown, different fastening devices such as tabs could be used that are spaced appropriately around it to prevent lateral movement or sliding of the seat when it is mounted on the bucket.

Various sizes and shapes can be utilized, depending on the particular type of conventional container such as bucket 14, can be used, which include three gallon buckets, five gallon buckets or any predetermined conventional container size as desired.

In use, the toilet seat 12*a* may be stored conventionally in any suitable location. When the seat is to be used for toilet functions, the seat is mounted on top of the conventional bucket firmly held in place so that the seat will not slide.

Figure 5:
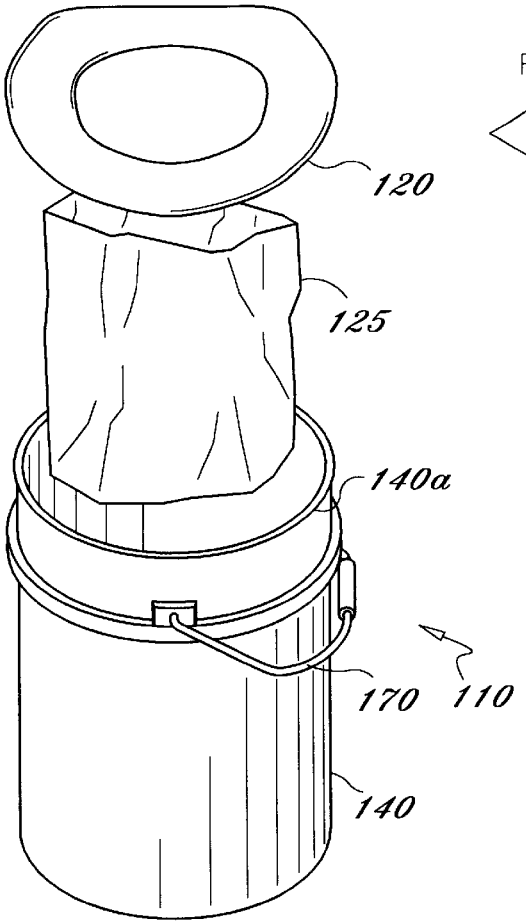
FIG. 5 is an exploded perspective view of a second embodiment of the present invention.

Referring to FIG. 5, a second embodiment of the present invention providing a portable toilet and waste receptacle system is illustrated generally at 110 comprising toilet seat 120, flexible waste container 125, and container 140, which can be a conventional bucket, or other container suitable for storage of waste products.

Flexible waste container 125 is any suitable flexible container as known in the medical waste disposal field for the disposal of waste products such as a heavy gauge plastic waterproof garbage or trash bag or medical disposal bag. The flexible disposable bags are sized to exceed the volume of a five gallon bucket and have an opening diameter that exceeds the diameter of a five gallon bucket so that the bag opening can fit over the bucket opening with overlap.

Toilet seat 120 is similar to the first embodiment toilet seat 12, except seat 120 is a somewhat different shape than seat 12. Furthermore, the features of the second embodiment of the present invention, as illustrated in FIGS. 5 through 12, that are the same as the features in the first embodiment, have the same reference numerals with 100 added thereto. In this manner, the description hereinabove covering the first embodiment applies equally to the second embodiment, and is reiterated herein with 100 added to each reference numeral, thus avoiding unnecessary repetition.

Figure 10:
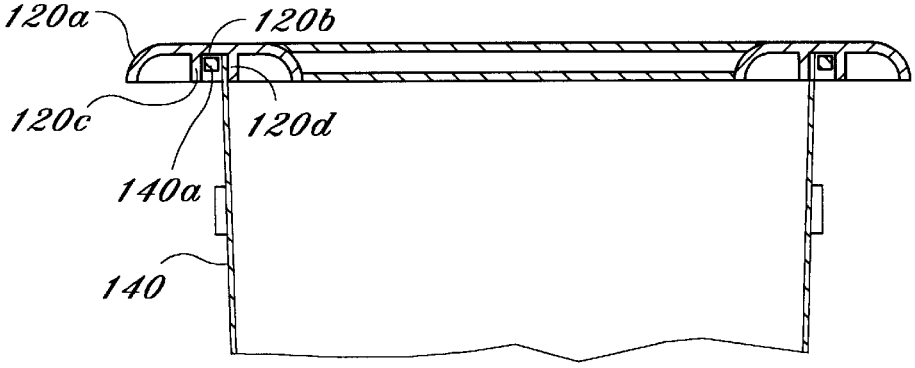
FIG. 10 is cross-sectional view taken along line 10—10 in FIG. 8.
Figure 12:
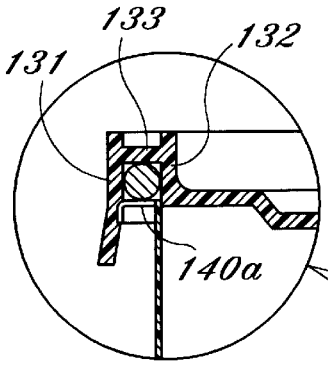
FIG. 12 is an enlarged cross-section of a portion of that shown in FIG. 11 detailing one embodiment for a sealing the lid.
Figure 11:
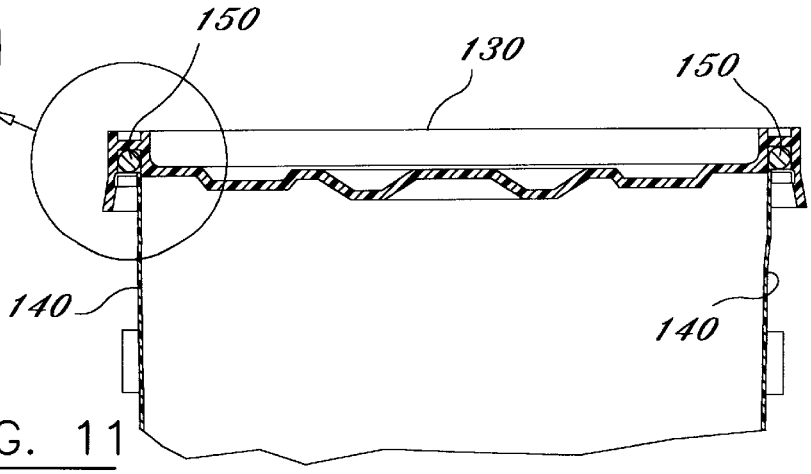
FIG. 11 is a cross-sectional view taken along line 11—11 in FIG. 7.

As illustrated in FIGS. 5, 6, 8 and 10, flexible waste container 125 is inserted within bucket 140 and folded back over upper rim 140*a*. Seat 120 is inserted upon rim 140*a* and secures a portion of container 125 between rim 140*a* and the annular region 120*b* between members 120*c* and 120*d*, as best illustrated in FIG. 10.

Figure 7:
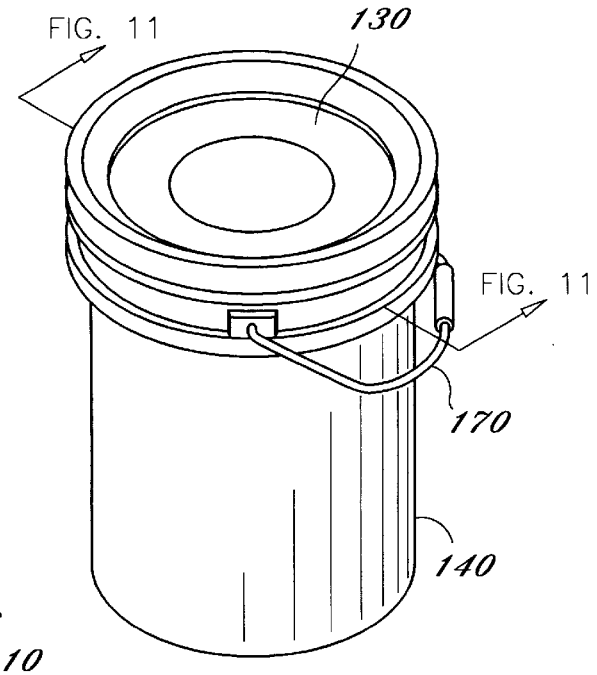
FIG. 7 is a perspective view of the second embodiment with the sealable lid in place.
Figure 6:
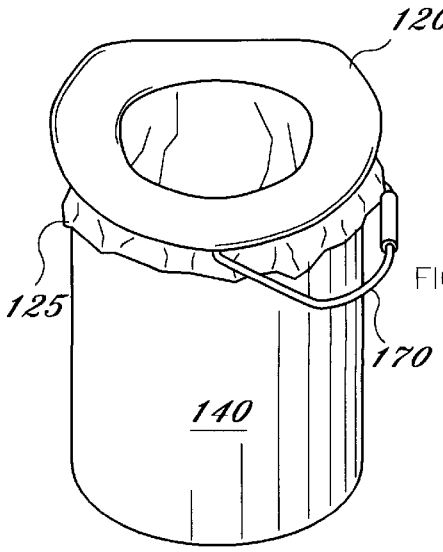
FIG. 6 is a perspective view of the embodiment of FIG. 5.
Figure 8:
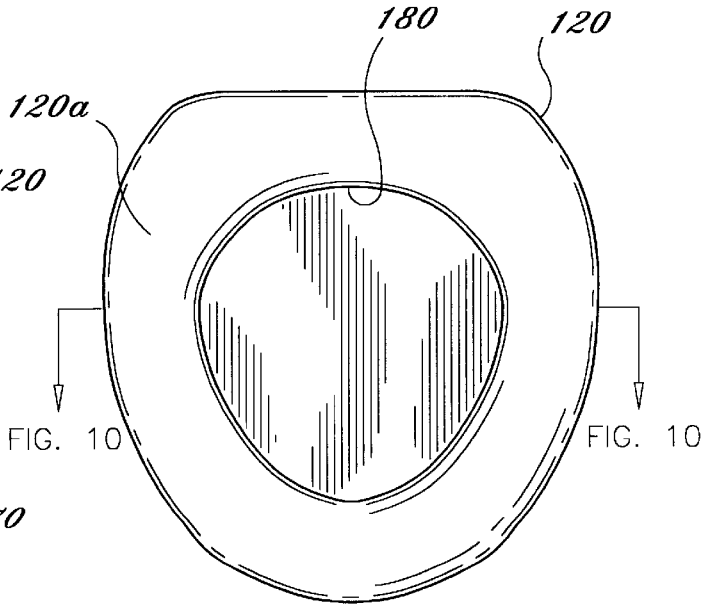
FIG. 8 is a top plan view of the second embodiment of the seat.
Figure 9:
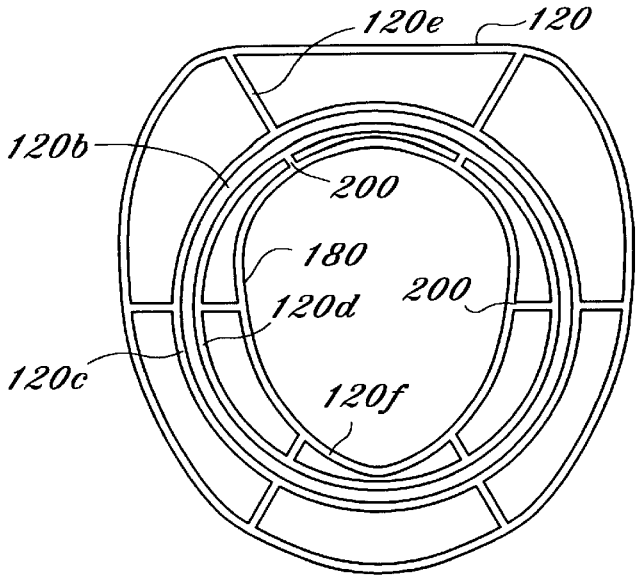
FIG. 9 is a bottom plan view of the seat of the second embodiment.

FIG. 7 illustrates one embodiment of a sealable lid 130 attached to bucket 140. As better illustrated in FIGS. 11 and 12, lid 130 can include a sealable gasket such as o-ring 150 which rests within a circular groove or annular cavity defined by rim 140*a*, surface 133, and circular wall members 131 and 132. When lid 130 is placed upon bucket 140, O-ring 150 effectively seals the interior of bucket 140 by slight compression against rim 140*a*, surface 133, and circular wall members 131 and 132. The lid could include a peripheral flange that permanently locks the lid to the bucket for hazardous conditions such as flooding where contamination of the flood waters could be a problem. A hospital using the present invention on a large scale may require a permanently sealed lid on each bucket. Other types of organic materials such as blood, soiled garments, needles or medical waste could be stored in the sealed buckets.

Lid 130, in conjunction with flexible waste container 125, converts bucket 140 into a safe portable waste receptacle and storage container.

In operation, flexible waste container 125 is inserted within bucket 140 with a portion folded back over rim 140*a*, to line the interior of bucket 140. Toilet seat 120 is then securely placed over the upper rim 140*a* of bucket 140 by insertion of rim 140*a* against surface 120*b* and within circular wall members 120*c* and 120*d*. A portable toilet 110 is thus provided.

After use, toilet seat 120 can be removed, flexible container 125 can be securely closed in conventional manner, and lid 130 can be secured to bucket 140 to seal-in the waste contents for safe storage, removal, and disposal.

Depending on circumstances, a fresh flexible container 125 can be utilized for each toilet use. After each use, container 125 can be sealed and placed into the bottom of bucket 140, and a fresh container 125 then utilized. When bucket 140 becomes full of individual sealed flexible containers, lid 130 can be secured to bucket 140 to seal the contents therein. Alternately, flexible container 125 can be utilized more than once prior to sealing flexible container 125 and placing lid 130 onto bucket 140.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable toilet seat and waste receptacle system, comprising:

a rigid body having a single, unobstructed aperture disposed therein, said rigid body sized and shaped for receiving and supporting the weight of a human being in a seated position for use as a toilet seat;

means for removably mounting said rigid body on a rigid container for receiving human waste;

a flexible container for storage of human waste, said flexible container mountable within the rigid container below said rigid body to retain human waste received through said aperture; and means for sealing the rigid container when said rigid body is removed therefrom.

2. The system of claim 1, wherein:

said rigid body includes a partially arcuate upper surface and a lower surface including said means for removably mounting said rigid body on a rigid container, said means having first and second supporting walls, said walls shaped in size to fit on an upper rim of the rigid container.

3. The system of claim 2, wherein:

said flexible container for storage of waste includes a portion disposed between said rigid body and said upper rim to secure said flexible container within the rigid container.

4. The system of claim 2, wherein:

said means for sealing the rigid container when said rigid body is removed therefrom includes a lid having an O-ring disposed on a lower annular cavity of said lid to seal between said lid and said upper rim of the rigid container wherein waste is sealable within the rigid container.

5. The system of claim 1, wherein said flexible container being sealable for retaining and storing waste received therein.

6. The method of providing an environmentally safe human toilet system for disposing of human waste safely and efficiently in emergency situations, outdoor environments, or marine environments comprising the steps of:

(a) providing a five gallon bucket;

(b) mounting a flexible waterproof container in said bucket;

(c) mounting a human toilet seat on said bucket;

(d) removing said toilet seat after use by a human;

(e) sealing said flexible container; and (f) permanently sealing said bucket with an airtight waterproof lid when said bucket is filled with flexible containers containing human waste.

* * * * *